United States Patent [19]

Stanton

[11] Patent Number: 5,058,794

[45] Date of Patent: Oct. 22, 1991

[54] APPARATUS TO ATTACH A FLEXIBLE MEMBER

[76] Inventor: Norman C. Stanton, P.O. Box 809, Tualatin, Oreg. 97062

[21] Appl. No.: 523,324

[22] Filed: May 14, 1990

[51] Int. Cl.[5] ..... B27F 7/02

[52] U.S. Cl. ..... 227/7; 227/12; 227/48; 227/120

[58] Field of Search ..... 227/5, 6, 7, 12, 13, 227/45, 46, 48, 39, 100, 103, 120

[56] References Cited

U.S. PATENT DOCUMENTS

| | | | |
|---|---|---|---|
| 2,947,001 | 8/1960 | Kamborian | 227/13 |
| 3,086,209 | 4/1963 | Kamborian | 227/13 |
| 3,193,164 | 7/1965 | Frasier | 227/39 |
| 3,527,397 | 9/1970 | Wortsmith | 227/13 |
| 3,583,295 | 6/1971 | Elder et al. | 93/51 |
| 4,478,361 | 10/1984 | McElhannon | 227/7 |
| 4,610,083 | 9/1986 | Campisi et al. | 227/6 |
| 4,809,899 | 3/1989 | Resta et al. | 227/25 |

*Primary Examiner*—Frank T. Yost
*Assistant Examiner*—Allan M. Schrock
*Attorney, Agent, or Firm*—Klarquist, Sparkman, Campbell, Leigh & Whinston

[57] ABSTRACT

The present invention is an apparatus to attach a continuous sheet of flexible material, such as fabric, to pairs of elongated rigid members such as wooden slats. The flexible member is attached on each side to one of the pairs of rigid members. A table supports the apparatus and has recessed guides longitudinally located on each side of the table. A magazine holder overlays each of the guides and each magazine holds a plurality of elongated rigid members in an aligned, vertically stacked, relationship. A pair of slides advances a pair of the rigid members, one along each guide to a first drive mechanism. The first drive mechanism advances each of the pair of elongated rigid members at a constant linear speed into an attachment zone. Flexible material is also guided into the attachment zone to lay atop each of the elongated rigid members. A pair of staplers, one overlaying each guide drives staples through the flexible material into the rigid members to attach the flexible material to each of the elongated rigid members. Subsequent elongated rigid members are automatically advanced into the attachment zone for continuous assembly.

4 Claims, 3 Drawing Sheets

APPARATUS TO ATTACH A FLEXIBLE MEMBER

TECHNICAL FIELD

This invention relates to an apparatus for attaching a flexible member to a pair of rigid members. Specifically, this invention attaches each side of continuous fabric sheet to elongated wooden members which are automatically fed into the assembly portion of the apparatus.

BACKGROUND ART

In the manufacture of furniture, such as couches and chairs, it is desirable to provide a spring-type suspension in the seat area. Generally, this is accomplished by fastening wire-formed spring elements to the wooden framework of the couch or chair. Other spring elements, such as rubber straps, have also been used.

A new seating support system has been developed by DuPont under the trade name of Dymetrol TM. This seating support is a fabric which will stretch and recover in a first direction but which will not stretch in a direction perpendicular to the first direction. This fabric material is fastened to one side of the framework of the couch or chair. The material is then stretched uniformly over the framework and attached to the opposite side of the framework of the couch or chair. Stretching the fabric over the framework is difficult and often results in nonuniform tension of the fabric. Uniformly attaching the fabric to the wooden framework is also difficult and depends upon the assembler's skill.

One solution is to preassemble the fabric onto elements of the framework of the couch or chair and then assemble the fabric covered framework into the remaining framework of the couch or chair. This allows the assembler to pull on a wooden rigid member rather than the flexible fabric when making the final assembly.

A need, therefore, exits for attaching a flexible member, such as fabric, to a pair of rigid members, such as wooden slats, uniformly and quickly.

SUMMARY OF INVENTION

It is an object of the invention to provide an apparatus to quickly and uniformly attach a flexible member to a pair of rigid members.

It is a further object of the invention to provide an apparatus which can automatically feed pairs of elongated rigid members into an apparatus where a flexible member is placed atop the rigid member and is attached thereto.

Another object of the invention is to provide an apparatus which can attach a continuous sheet of flexible material to a plurality of elongated rigid members, each of the rigid members having a set length wherein the apparatus can feed the rigid members automatically in a continuous end-to-end relationship.

Still another object of the invention is to provide a method and apparatus for attaching a stretched flexible fabric to a rigid frame such that the fabric is under uniform tension for its entire length.

A pair of magazines or holders for holding a plurality of pairs of elongated rigid members are spaced apart on a support table. A slide mechanism advances the pair of rigid members, such as wooden slats, one from each magazine in a first direction along guides to a first drive mechanism. The first drive mechanism advances the rigid members into an attachment zone where a flexible member, such a fabric sheet, is placed upon the rigid members and attached thereto. A second drive mechanism coupled to the first drive mechanism propels the assembly out of the attachment zone.

The slide mechanism advances the elongated rigid members to a first predetermined position upstream of the first drive means until a previous rigid member clears a second predetermined position beneath the first drive means. This prevents the slide mechanism from advancing the elongated rigid member faster than the first drive means.

Staplers, on each side of the apparatus, drives staples through the flexible member, on the outside edges of the flexible member, into the rigid members to attach the flexible member to the rigid member. This attachment causes the flexible member to advance at the same speed as the rigid members.

Other objects and advantages of the present invention will be apparent from the following description of a preferred embodiment thereof and from the attached drawings.

DETAILED DESCRIPTION OF THE INVENTION

Figure 1:
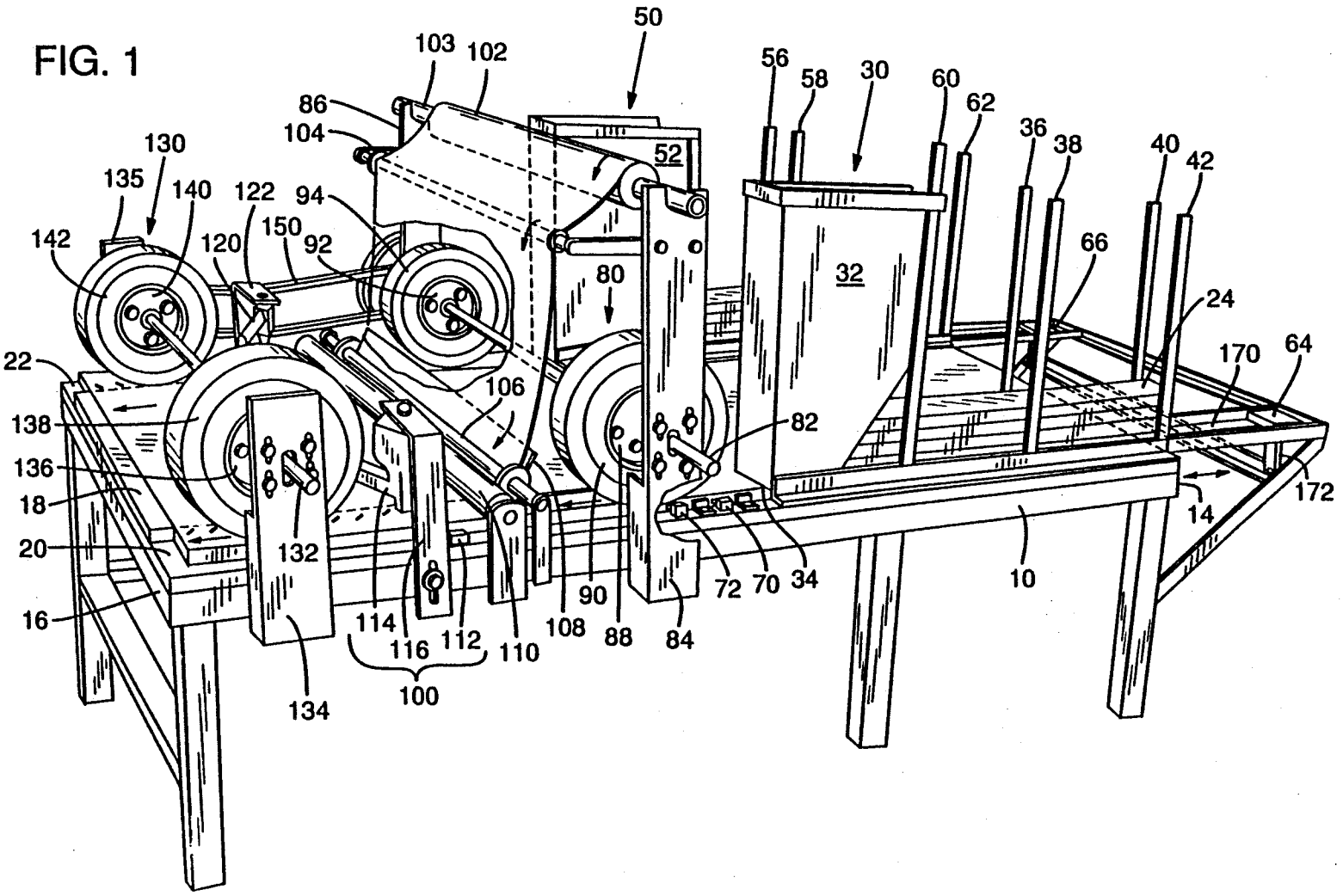
FIG. 1 is a partially broken away perspective view of the apparatus of the present invention.

Referring now to FIG. 1, a support table 10 is provided to hold the apparatus of the present invention. The support table 10 has an upstream end 14 and a downstream end 16. A top surface 18 of the support table 10 is straddled by two longitudinal extending, laterally spaced recesses 20 and 22, one on each side of the support table 10. The recesses 20 and 22 each provide a guide for one of a pair of laterally spaced rigid members 24. Rigid members 24 may serve, for example, as frame components of a sofa or chair. The recesses 20 and 22 are below the top surface 18 by a distance equal to the thickness of the elongated rigid member 24.

A first magazine or holder 30 is provided on the upstream end 14 of the support table. The magazine or holder 30 has a front portion 32 which holds the front portion of one group of rigid members 24 in a vertically aligned stacked relationship. Front portion 32 has a closed front end and partially closed side portions to maintain a stack of a plurality of rigid members 24 in a vertical aligned position, one on top of another. A bottom opening 34, slightly greater in height than the thickness of the lower most rigid member 24, is provided in a lower portion of the front portion 32 of the magazine 30. Additional support for the rigid members 24 is provided by vertical opposed side members 36 and 38 on top of the table 10. Similarly, additional opposed side members 40 and 42 are provided to support the distal end of the rigid member 24.

A similar magazine or holder 50 is provided on the opposite side of the table 10 to retain a second group of rigid members 24 in a vertically aligned stacked arrangement. This magazine or holder 50 also has a front portion 52 similar to the front portion 32 of the first magazine 30. Similar side members 56 and 58 support the elongated rigid members 24 at their mid-point and two additional side members 60 and 62 hold additional rigid members 24 at their distal end.

An advancement mechanism, as will be explained below, has a pair of slides 64 and 66 for engaging simultaneously the lower most pair of rigid members 24 held respectively in the first magazine 30 and the second magazine 50.

A first detector 70 mounted downstream from the magazine 30 detects the presence or absence of a rigid member 24 at a first predetermined position along recess 20. A second detector 72 positioned downstream from the first detector 70 detects the presence or the absence of a rigid member at a second predetermined position along recess 20.

A first drive mechanism 80 is located coincidental with the second predetermined position as indicated by detector 72. The drive mechanism 80 is mounted on a shaft 82 which is held by a vertical support 84 mounted on a first side of the table 10 and a corresponding vertical support 86 mounted on the opposite side of the table 10. The shaft 82 is held in bearings (not shown) and is adjustable in a vertical direction.

Rigidly attached to the shaft 82 is a first wheel 88 having a pneumatic tire 90 mounted thereon. The pneumatic tire 90 overlays the first recessed area 20 of the table 10 and is adjusted in the vertical position to contact a rigid member in the recessed area 20 sufficiently to propel the member in a first direction as shown by the arrow in FIG. 1.

A second wheel 92 is rigidly mounted to shaft 82 on the opposite side of the support table 10. Another tire 94 is mounted to wheel 92 and overlays the second recessed area or guide 22.

An attachment zone 100 is located downstream from the first drive mechanism 80.

A roll of flexible material 102 is held on a rotatable shaft 103 which is supported by notched portions of support members 84 and 86 above the first drive mechanism 80. The flexible material 102 traverses guides 104 and 106 and is protected by a flat guide 108 before advancing beneath roller 110. Roller 110 is positioned above the top surface 18 of the table 10 and guides the flexible material onto the top of each of the rigid supports 24 in the recessed areas 20 and 22 of table 10.

A third detector 112 located downstream from the roller 110 detects the presence or the absence of a rigid member 24 in a third predetermined location. Detector 112, when it detects the presence of a rigid member 24, activates staple machines 114 and 120. Staple machines 114 and 120, which are each located above one of the recesses 20, 22 opposite one another, serve to staple the flexible material to the top surface of the underlying rigid member as it is advanced in the first direction. Staple machine 114 is held in position by a movable support 116 attached to table 10 while staple machine 120 is supported by movable support 122 attached to the opposite side of table 10.

A second drive mechanism 130 is located downstream from the attachment zone 100. Drive mechanism 130 is supported by a shaft 132 having opposite ends held by vertically adjustable bearings (not shown), one of which is mounted in a vertical support 134 which is attached to table 10. A similar support 135 is attached to the opposite side of table 10. A wheel 136 is rigidly attached to shaft 132. A pneumatic tire 138 is mounted on wheel 136 and overlays the recess or guide 20. A second wheel 140 is rigidly attached to shaft 132 on the opposite side of table 10. A second pneumatic tire 142 is mounted on wheel 140 and overlays the recessed or guide area 22. Shaft 132 is coupled to shaft 82 by means of a chain 150 and sprockets (not shown) attached to each shaft. This allows the first drive mechanism 80 and the second drive mechanism 130 to rotate in the same direction at the same rotational speed.

Figure 2:
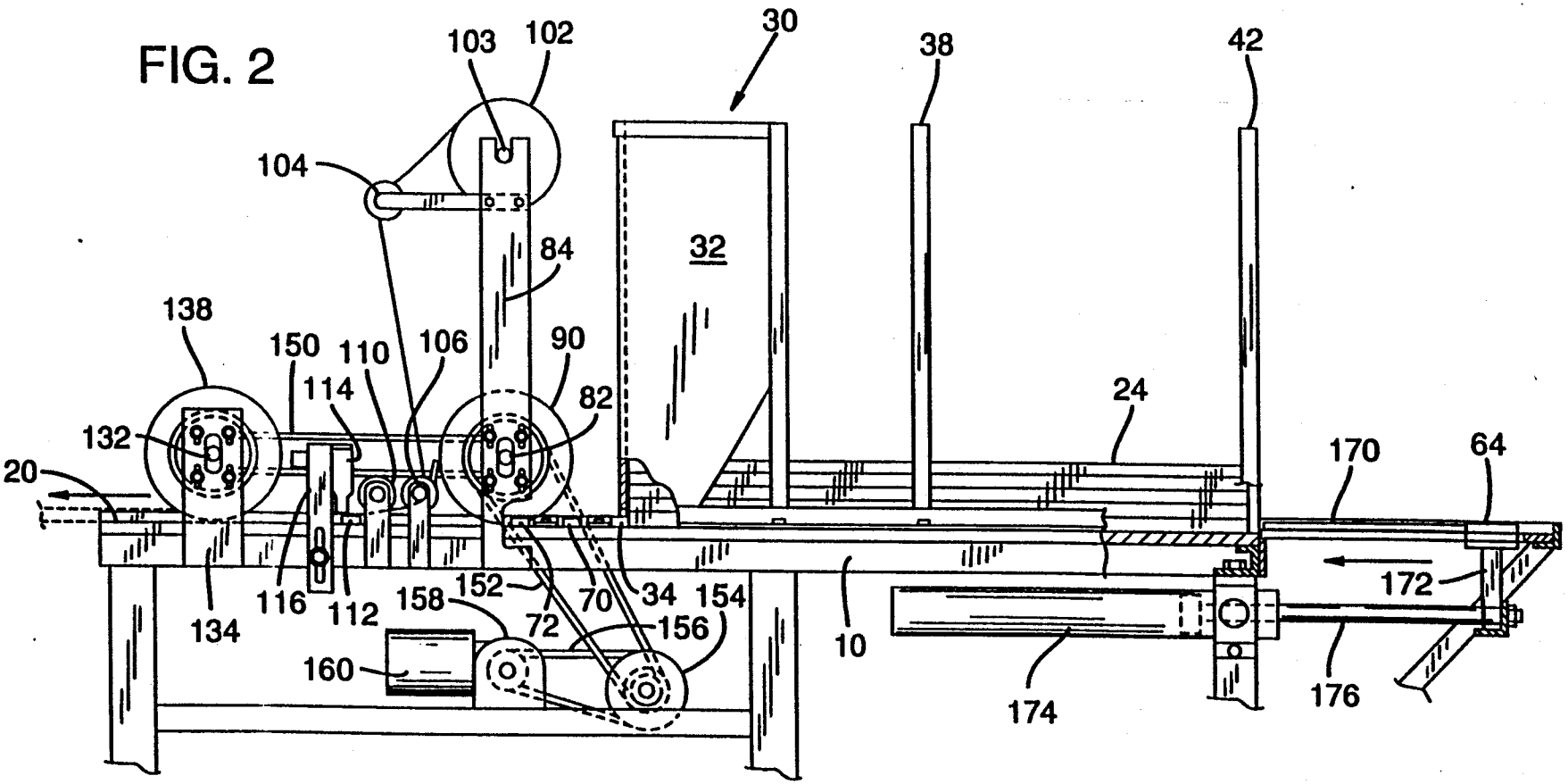
FIG. 2 is a partially broken away side view of the apparatus of the present invention.

Referring now to FIG. 2, a second drive chain 152 is mounted on a sprocket (not shown) rigidly attached to shaft 82. Chain 152 is also attached to a gear reduction gearbox 154 which is coupled by chain 156 to a gearbox 158 which is in combination with a motor 160. In this manner, rotation of the motor 160 causes chain 156 to rotate causing chain 152 to rotate shaft 82 and consequently through chain 150 to rotate shaft 132.

Slide 66 has a push bar 170 attached thereto. When fully retracted, push bar 170 does not contact any of the rigid members 24. Advancement of the push bar in the direction of the arrow shown in FIG. 2 advances the lower most rigid member 24 out of the magazine 30 through the front opening 34 to the first detector 70. The slide 66 is connected to a cross member 172 which is attached to a cylinder rod 176 of a hydraulic cylinder 174. Activation of cylinder 174 retracts the cylinder rod 176 forcing the cross member and the guide 66 in the direction of the arrow shown.

Figure 3:
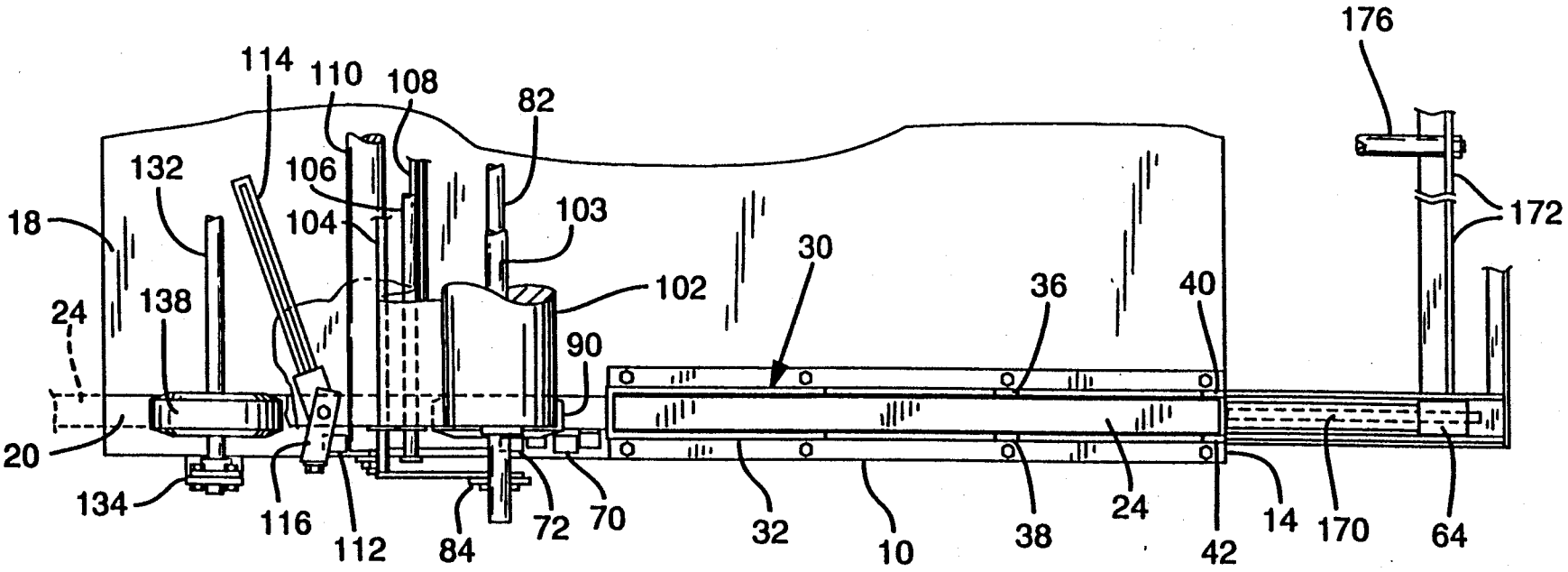
FIG. 3 is a top view of the apparatus of the present invention.

To prevent the hydraulic cylinder 174 from overriding the first drive mechanism 80 the hydraulic cylinder only advances the rigid member 24 to the first detector 70 until the second detector 72 beneath the first drive mechanism 80 detects the absence of a rigid member 24. The hydraulic cylinder 174 then advances the rigid member 24 to the second detector 72 which allows the drive mechanism 80 to advance the rigid member 24 in a first direction. The cylinder rod 176 of the hydraulic cylinder 174 is then fully extended bringing the push bar 170 back to its initial starting position. As can be seen in FIG. 3, the cross member 172 simultaneously activates both slides 64 and 66 to simultaneously advance a pair of rigid members into the first drive mechanism 80.

After the second drive mechanism 130 advances the assembled fabric 102 and rigid members 24 out of the attachment zone 100, the fabric 102 is cut across its width at the point where the leading end of one rigid member meets the trailing end of the next rigid members 24 by any conventional means (not shown). Each individual assembly is then transferred to the final assembly point where it is attached to the remaining framework of a couch or chair.

OPERATION

To begin the assembly process, a plurality of elongated rigid members 24 are stacked one upon another into the first magazine 30. The rigid members are advanced so that the leading edge of each contacts the front portion 32 of the magazine 30. A second plurality of rigid members are stacked one upon the other and placed in the second magazine 50. Again, the front edge or the leading edge of each of the elongated members is aligned into the front portion 52 of the magazine 50. The lower most rigid member 24 in magazine 30 is advanced through opening 34 until the leading edge of the rigid member 24 is approximately 1" downstream from the stapler 114. Similarly, the lower most rigid member of magazine 50 is advanced until the leading edge of that rigid member 24 is approximately 1" downstream from stapler 120. Each of the rigid members, that is the rigid member 24 in guide 20 which is 1" beyond the stapler 114 and the second rigid member 24 in guide 22 which is 1" downstream from the stapler 120, are aligned so that they are parallel to one another on the table 10.

A shaft 103 is placed through the center of the roll of flexible material 102 and the shaft 103 is placed in the notch in frame member 84 and the notch in frame member 86. The fabric 102 is led over guide 104 and between guide !06 and flat guide !08. The flexible material 102 is then pulled beneath roll 110 and underneath stapler 114 and stapler 120 until its leading edge matches the leading edge of rigid member 24 in guide 20 and rigid member 24 in guide 22. The flexible member 102 is then temporarily stapled by means of an auxiliary staple gun to each of the rigid members.

The air which operates stapler 114 and stapler 120 and the hydraulic cylinder 174 is turned on. The motor 160 is also turned on. The first drive mechanism 80 advances each of the elongated rigid members 24 along the respective guides. The third detector 112 detecting the presence of the rigid members 24 and activates staplers 114 and 120 to drive staples through the flexible member 102 into each of the rigid members 24. The advancement of each of the rigid members by the first drive mechanism 80 evenly and linearly pulls the flexible member !02 along with the rigid members 24. The roller 110 insures that the flexible member 102 advances on top of each of the rigid members 24 in an even manner without wrinkling, bunching, or gathering.

When the first detector 70 detects that no rigid member 24 is present, it sends an electrical signal to a controller which applies air pressure to the pneumatic cylinder 174 which retracts the cylinder rod 176 and advances slide 64 and 66 to advance a new pair of rigid members 24 up to the first predetermined position determined by the position of the first detector 70. Advancement of the rigid members 24 is halted until the second detector 72 detects that no rigid member is at the second predetermined position. When detector 72 detects that no rigid member is at the second predetermined position, an electrical signal is sent to a controller which then advances pneumatic cylinder 174 to force each of the pair of rigid members 24 to the second predetermined position which underlays drive mechanism 80. A mechanical stop (not shown) within pneumatic cylinder 174 halts advancement at the second predetermined position. Pneumatic cylinder 174 then extends the cylinder rod 176 to force the slide 64 and 66 back to their beginning positions. The drive mechanism 80 then begins advancing the second pair of rigid members in the first direction. As the first magazine 30 and the second magazine 50 begin to exhaust their stock of elongated rigid members 24, the magazines may be refilled and the process continues until the roll of flexible material 102 is completely exhausted. As long as a rigid member 24 is in the third predetermined position determined by the third detector 112, the staplers 114 and 120 will continue to drive staples through the flexible material 102 into each of the pair rigid members 24. The spacing of each subsequent staple is determined by the linear speed set by the first drive mechanism 80 and the second drive mechanism 130 and the air pressure supplied to the staple guns. Staple gun 114 is adjustable on bracket 116 to change the angle that the staples are driven into the rigid members. Similarly, staple gun 120 is adjustable on support bracket 122 to adjust the angle of the staples driven into each of the rigid members.

It should be noted that the apparatus of the present invention may be adjustable in width to accommodate different widths of flexible members. Similar adjustments may be built into the apparatus to accommodate different lengths of rigid members.

Having illustrated and described the principles of the invention in a preferred embodiment, it should be apparent to those skilled in the art that the invention can be modified in arrangement and detail without departing from such principles.

I claim all modifications coming within the spirit and scope of the following claims:

1. An apparatus for attaching flexible material to a pair of rigid members comprising:

a magazine means to contain a plurality of elongated rigid members;

an advancement means to sequentially advance pairs of the rigid members from said magazine means;

a first drive means to propel one of said pair of rigid members in a first direction, said first drive means including at least one pneumatic tire for contact with one of said pair of rigid members;

a support means for holding a roll of flexible material;

a guide means to guide said flexible material from said support means into contact with said advancing pair of rigid members;

an attachment means to attach said flexible material onto said pair of rigid members to form an assembly; and a second drive means to propel said assembly in said first direction, said second drive means including at least one pneumatic tire for contact with said assembly.

2. An apparatus to attach flexible material to rigid members comprising:

a holder means for containing a plurality of elongated rigid members in a vertically stacked arrangement;

a means to advance a pair of said rigid members from said holder means in a first direction;

a first detector means to detect advancement of said rigid members by said slide means to a first predetermined position;

a first drive means to advance said pair of rigid members at a constant linear speed in said first direction into an attachment zone;

a second detection means to detect advancement of said pair of rigid members from a second predetermined position, downstream from said first predetermined position, said second predetermined position being beneath said first drive means;

a means to advance said pair of rigid members from said first predetermined position to said second predetermined position for subsequent advancement by said first drive means;

a support means for holding a roll of flexible material;

a guide means for guiding said flexible material from said support means into contact with said pair of rigid members in said attachment zone;

an attachment means located in said attachment zone for attaching said flexible material to said pair of rigid members to form an assembly;

a second drive means to propel said assembly from said attachment zone, wherein the spacing between said first drive means and said second drive means is less than the length of said elongated rigid member.

3. The apparatus of claim 2 wherein said slide means advances said rigid members to said first position after the previous rigid members have advanced beyond said first position and then advances said rigid members to said second position after the previous rigid members have advanced beyond said second position.

4. An apparatus to attach flexible material to rigid members comprising:

a holder means for containing a plurality of elongated rigid members;

a slide means to advance pairs of said rigid members from said holder means in a first direction;

a first detector means to detect advancement of a pair of said rigid members by said slide means to a first predetermined position;

a first drive means to advance said pair of rigid members at a constant linear speed in a first direction into an attachment zone;

a second detector means to detect advancement of said pair of rigid members from a second predetermined position, downstream from said first predetermined position, said second predetermined position being beneath said first drive means;

a first control means to activate said slide means to advance said pair of rigid members from said first predetermined position to said second predetermined position for subsequent advancement by said first drive means;

a support means for holding a roll of flexible material;

a guide means for guiding said flexible material from said support means onto said pair or rigid members in said attachment zone;

an attachment means located in said attachment zone for attaching said flexible material to said pair of rigid members to form an assembly;

a third detection means located downstream from said second detection means but located upstream of said attachment means to detect the presence of a rigid member in a third predetermined position;

a second control means responsive to said third detection means to activate said attachment means when said rigid members are at the third predetermined position; and a second drive means to propel said assembly from said attachment zone, wherein the spacing between said first drive means and said second drive means is less than the length of said elongated rigid member.

* * * * *